US010813507B2

(12) United States Patent
Marquardt

(10) Patent No.: US 10,813,507 B2
(45) Date of Patent: Oct. 27, 2020

(54) MULTIPLE STAGE DISCHARGE SYSTEM FOR A FLUID TANK

(71) Applicant: Bradley Fixtures Corporation, Menomonee Falls, WI (US)

(72) Inventor: Terry L. Marquardt, Menomonee Falls, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 64 days.

(21) Appl. No.: 15/976,434

(22) Filed: May 10, 2018

(65) Prior Publication Data

US 2018/0325325 A1 Nov. 15, 2018

Related U.S. Application Data

(60) Provisional application No. 62/504,949, filed on May 11, 2017.

(51) Int. Cl.
*A47K 3/28* (2006.01)
*F04F 10/02* (2006.01)

(52) U.S. Cl.
CPC ..... *A47K 3/286* (2013.01); *A47K 3/288* (2013.01); *F04F 10/02* (2013.01)

(58) Field of Classification Search
CPC ..... A47K 3/286; A47K 3/288; F04F 10/02
USPC ..... 4/602
See application file for complete search history.

(56) References Cited

U.S. PATENT DOCUMENTS

| | | | | |
|---|---|---|---|---|
| 553,046 | A * | 1/1896 | Wenger | A47K 3/288 4/602 |
| 1,235,164 | A | 7/1917 | Sessions | |
| 1,342,874 | A | 6/1920 | Sessions | |
| 1,785,149 | A | 12/1930 | Smith | |
| 1,817,379 | A | 8/1931 | Kallmeyer | |
| 1,957,365 | A | 5/1934 | Stewart | |
| 2,199,611 | A | 5/1940 | Blanchard | |
| 2,544,092 | A | 3/1951 | Karlson | |
| 2,567,506 | A | 9/1951 | Bowman | |
| 2,801,645 | A | 8/1957 | White | |
| 3,593,740 | A | 7/1971 | Harrison et al. | |
| 3,734,124 | A | 5/1973 | Zanoni et al. | |
| 4,084,270 | A | 4/1978 | Kersten, Jr. | |
| 4,096,591 | A * | 6/1978 | Awis | E03D 1/145 4/326 |
| 4,185,338 | A * | 1/1980 | Bresnyan | E03D 1/145 4/327 |
| 4,235,827 | A | 11/1980 | Gopel | |
| 5,265,288 | A | 11/1993 | Allison | |

(Continued)

OTHER PUBLICATIONS

International Search Report and Written Opinion regarding Int'l Appl. No. PCT/US2018/032111, dated Sep. 21, 2018, 14 pps.

*Primary Examiner* — Christine J Skubinna
(74) *Attorney, Agent, or Firm* — Foley & Lardner LLP

(57) ABSTRACT

A multiple stage discharge system for a gravity-fed emergency shower system is provided herein. The multiple stage discharge system includes a drain; a first opening defined by the drain; a second opening defined by the drain; and a valve mechanism coupled to the second opening to permit fluid in a fluid tank of the gravity-fed emergency shower system to flow at least partly through the drain via the second opening in response to a fluid level in the fluid tank decreasing to at or below a threshold fluid level.

20 Claims, 4 Drawing Sheets

(56) References Cited

U.S. PATENT DOCUMENTS

| | | | |
|---|---|---|---|
| 5,331,694 | A | 7/1994 | Mackenzie et al. |
| 5,350,112 | A | 9/1994 | Stein |
| 5,544,369 | A | 8/1996 | Roberts |
| 5,623,990 | A | 4/1997 | Pirkle |
| 6,681,417 | B2 | 1/2004 | Brunelle et al. |
| 6,711,758 | B1 | 3/2004 | Terek et al. |
| 6,962,005 | B1 | 11/2005 | Khosropour et al. |
| 6,978,496 | B2 | 12/2005 | Adrian |
| 7,007,316 | B2 | 3/2006 | Lutz, II |
| 7,013,504 | B2 | 3/2006 | Brunelle et al. |
| 7,135,035 | B1 | 11/2006 | Dimmick |
| 7,243,381 | B2 | 7/2007 | Lutz, II |
| 7,506,386 | B1 | 3/2009 | Adrian |
| 7,657,950 | B2 | 2/2010 | Robert et al. |
| 8,001,628 | B2 | 8/2011 | Eveleigh et al. |
| 8,209,796 | B2 | 7/2012 | Eveleigh et al. |
| 8,316,478 | B2 | 11/2012 | Strandberg et al. |
| 8,566,974 | B2 | 10/2013 | Strandberg et al. |
| 8,595,869 | B2 | 12/2013 | Eveleigh et al. |
| 8,839,468 | B2 | 9/2014 | Strandberg et al. |
| 8,887,322 | B1 | 11/2014 | Adrian |
| 9,161,882 | B2 | 10/2015 | Faridoon |
| 9,220,658 | B2 | 12/2015 | Eveleigh et al. |
| 9,235,220 | B2 | 1/2016 | Goncze |
| 9,756,988 | B2 | 9/2017 | Beuhring et al. |
| 2002/0053044 | A1 | 5/2002 | Gold et al. |
| 2002/0153044 | A1 | 10/2002 | Lee |
| 2012/0260417 | A1 | 10/2012 | Leblanc |
| 2013/0133134 | A1 | 5/2013 | Faridoon |
| 2014/0283295 | A1 | 9/2014 | Eveleigh et al. |
| 2015/0313417 | A1 | 11/2015 | Allred |

* cited by examiner

MULTIPLE STAGE DISCHARGE SYSTEM FOR A FLUID TANK

CROSS-REFERENCE TO RELATED PATENT APPLICATION

This application claims the benefit of U.S. Provisional Application No. 62/504,949, filed May 11, 2017, which is incorporated herein by reference in its entirety.

TECHNICAL FIELD

The present disclosure relates to fluid tanks. More particularly, the present disclosure relates to a multiple stage discharge system for a fluid tank, such as a water tank for an emergency shower system.

BACKGROUND

Emergency wash systems include emergency eyewash systems, emergency facewash/eyewash systems, emergency shower systems, and a combination of these systems. An emergency shower system is designed to provide fluid, such as water, to the body of a person affected by a substance that he/she wishes to remove/wash away. In comparison, emergency eyewash or emergency facewash systems are designed to provide fluid, such as water, to a focused region of the person such as their eyes or face, respectively.

Emergency shower systems can be plumbed to a fluid source/supply that drives, powers, or otherwise moves the fluid from the source/supply to the discharge outlet (e.g., a shower fixture) of the shower system upon actuation of a discharge control mechanism. Alternatively, emergency shower systems can be gravity-fed, which indicates that a tank of fluid is positioned vertically above or substantially vertically above the discharge outlet. Upon actuation of the discharge control mechanism, the fluid in the tank under the force of gravity is discharged via the discharge outlet.

Gravity-fed emergency shower systems are beneficial because of their mobility. In this regard, the gravity-fed emergency shower system may be moved or transported to a variety of locations (indoors and outdoors) independent of the location of a fluid source. However, one problem with these gravity-fed emergency shower systems is that in order to achieve a longer runtime (i.e., the time duration that the tank may discharge fluid) with a minimum desired pressure discharge, a larger tank is typically required. But, the larger tank may be undesirable due to the size, weight, and costs. Accordingly, better systems are desired.

SUMMARY

One exemplary embodiment relates to a gravity-fed shower system. The gravity-fed shower system includes a fluid tank, and a multiple stage discharge system coupled to the fluid tank and structured to at least partly control a fluid flow from the fluid tank. According to one embodiment, the multiple stage discharge system includes a drain; a first opening defined by the drain; a second opening defined by the drain; and, a valve mechanism coupled to the second opening to permit fluid in the fluid tank to flow through the drain via the second opening in response to a fluid level in the fluid tank decreasing to at or below a threshold fluid level.

Another exemplary embodiment relates to a multiple stage discharge system for a gravity-fed emergency shower system. The multiple stage discharge system includes a drain; a first opening defined by the drain; a second opening defined by the drain; and, a valve mechanism coupled to the second opening to permit fluid in a fluid tank of the gravity-fed emergency shower system to flow at least partly through the drain via the second opening in response to a fluid level in the fluid tank decreasing to at or below a threshold fluid level.

Yet another exemplary embodiment relates to a method of controlling the discharge pressure of the fluid in a fluid tank of a gravity-fed emergency shower system. The method includes: providing a fluid tank structured to hold a volume of fluid; disposing a drain at least partly within the fluid tank, wherein the drain is coupled to the fluid tank; providing a first opening in the drain; providing a second opening in the drain; disposing a valve in the drain, wherein the valve is movable between an open position and a closed position, wherein in the open position, the valve permits fluid in the fluid tank to flow through the second opening into the drain and wherein in the closed position, the valve prevents fluid in the fluid tank to flow through the second opening into the drain; and moving the valve to the open position in response to the fluid in the fluid tank decreasing.

The present disclosure further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the inventions described herein.

DETAILED DESCRIPTION

Figure 1:
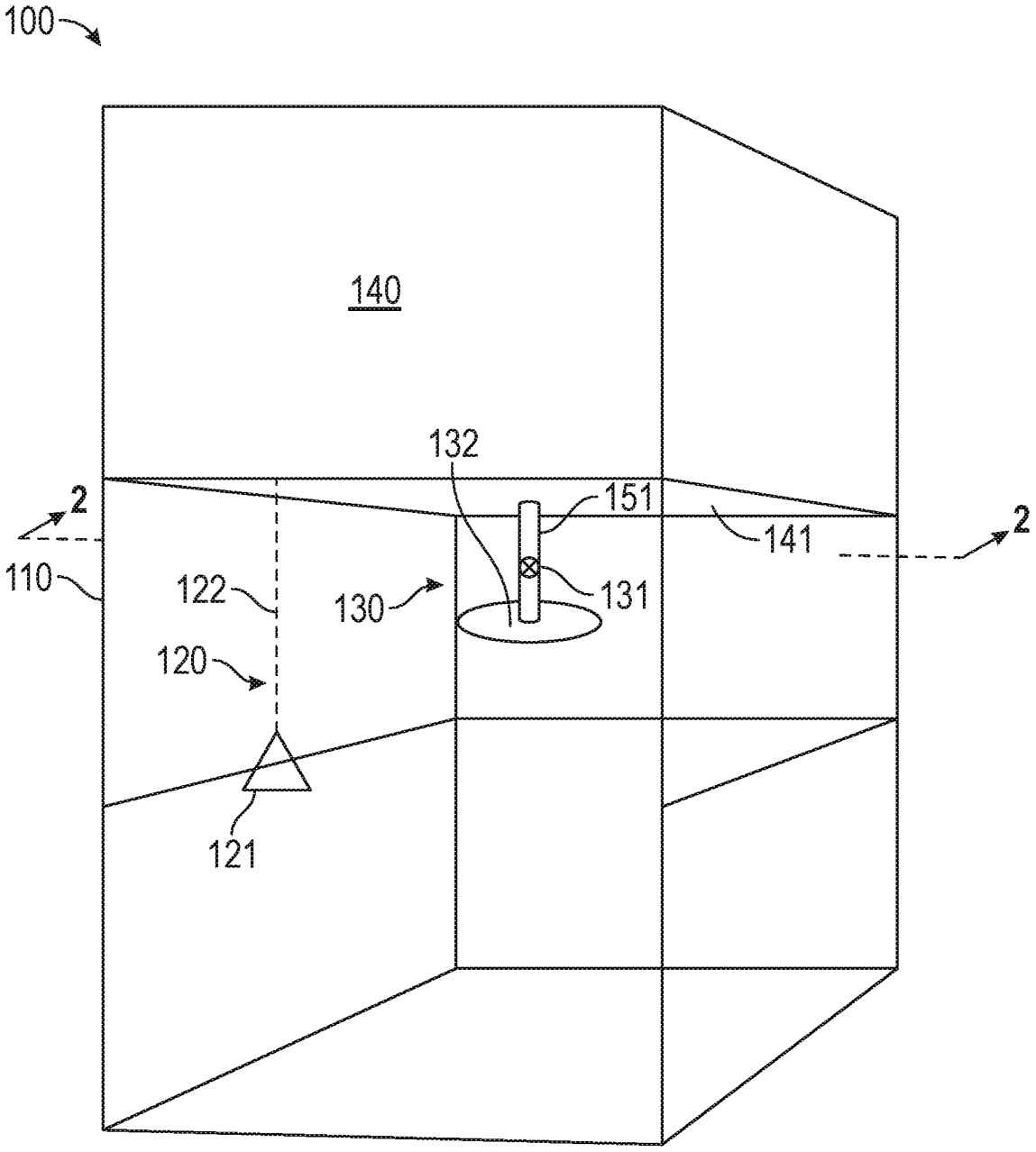
FIG. 1 is a perspective view of an emergency wash system, shown as a gravity-fed emergency shower system, according to an exemplary embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the Figures generally, various embodiments disclosed herein relate to a multiple stage discharge system for a gravity-fed emergency fixture, such as an emergency drench shower, eyewash, facewash, or the like. According to one embodiment, the gravity-fed emergency fixture is an emergency shower system that is used to drench a person with a fluid (e.g., water). According to the present disclosure, a gravity-fed emergency shower system includes a fluid tank and the multiple stage discharge system. The multiple stage discharge system is disposed within or partly within the fluid tank and is fluidly coupled to a shower head that is configured to provide fluid in the fluid tank to a user of the gravity-fed emergency shower system. The multiple stage discharge system includes a first opening defined by a drain (i.e., the first stage) and a second opening defined by the drain (i.e., the second stage), where each of the first and second openings are disposed within the fluid tank. The first opening (e.g., first orifice or primary orifice, first inlet, etc.) is positioned vertically below the second opening (e.g., second orifice or secondary orifice, second inlet, etc.), such that the first opening is relatively closer to a bottom of the fluid tank than the second opening. According to the present disclosure, the second opening includes a valve mechanism while the first opening is permanently open. In this regard, the first opening may continuously direct fluid in the fluid tank to the shower head. However and due to the valve mechanism, the second opening only selectively provides fluid to the shower head. More particularly and in one embodiment, the valve mechanism is structured as a float valve where the float moves within the fluid tank as the fluid level in the fluid tank changes. In particular, as the fluid level decreases, the float actuates the valve open to permit fluid flow through the second opening. As such and in response to a decrease in fluid in the fluid tank, the fluid provided via the second opening combines with that provided via the first opening to at least one of increase or maintain a desired flow rate from the fluid tank to the shower head. Beneficially, such a configuration may extend the time duration that a minimum flow rate of fluid may be provided from the fluid tank to the shower head as compared to conventional gravity-fed emergency shower systems. The flow rate of fluid through the shower head directly relates to the pressure at the shower head. Accordingly, the minimum flow rate has a corresponding minimum pressure.

Because the multiple stage discharge system described herein may provide fluid at a minimum pressure longer than conventional gravity-fed emergency shower systems, the multiple stage discharge system of the present disclosure provides several benefits and advantages over conventional gravity-fed emergency shower systems. For example, the size of the fluid tank does not need to be increased to accommodate relatively longer discharge durations at a minimum pressure. Further, complicated solutions intended to provide a minimum pressure for an extended period of time, such as creating a vacuum in the fluid tank or utilizing pressurized gas to push the fluid out of the tank at the minimum pressure, are avoided. As a result, the multiple stage discharge system of the present disclosure may be implemented relatively inexpensively and easily because the system is implemented without the need to pressurize the tank, the use of electronics, and without or substantially without user concern regarding various sealing features of the fluid tank (e.g., if the fluid tank needs to be pressurized, the user would need to ensure that proper seals are implemented to maintain the pressure).

Moreover and in addition to extending the runtime of the shower at the minimum desired pressure and flow rate, the multiple stage discharge system may also function to conserve fluid to thereby provide a more ecofriendly system than conventional gravity-fed shower systems. In conventional gravity-fed shower systems, until the water in the fluid tank decreases from full to nearly empty, the water pressure is greater than the minimum requirement, which results in using more water per minute than is desired for most of the runtime of the shower. In these conventional systems, a larger water tank would be needed if the water flow rate were constant and near the minimum. Beneficially, the first stage of the multiple stage discharge system of the present disclosure restricts fluid flow to at or only slightly above a minimum desired flow rate to conserve water (yet still meet a minimum desired flow rate), reducing unnecessary fluid use as compared to conventional systems. These and other features and benefits are described more fully herein below.

It should be understood that while the present disclosure describes the emergency shower system as emitting, providing, or otherwise discharging a "fluid," this is done on purpose as the present disclosure contemplates that the type of fluid may be highly configurable. For example and in one embodiment, the type of fluid is water. In another example, the fluid may be a mixture of water and an additive. Thus, those of ordinary skill in the art will appreciate and recognize that the emergency shower system of the present disclosure may provide water in addition to various other types of fluids with all such variations intended to fall within the scope of the present disclosure.

Referring now to FIG. 1, an emergency fixture system or gravity-fed shower system, shown as a gravity-fed emergency shower system 100, is depicted according to an exemplary embodiment. The gravity-fed emergency shower system 100 includes a frame 110, a fluid tank 140 supported by the frame 110, a control mechanism 120, and a discharge system 130 actuated by the control mechanism 120 and fluidly coupled to the fluid tank 140.

The frame 110 is structured to support the fluid tank 140 above a support surface for the gravity-fed emergency shower system 100. In this regard, the frame 110 may be coupled to the fluid tank 140 via one or more fasteners, snap-connections, a rest-type engagement (e.g., where the fluid tank 140 simply rests upon the frame 110), and/or any other type of coupling mechanism. The frame 110 may also be structured to support other components of the gravity-fed emergency shower system 100 as well. For example, while the discharge system 130 is shown coupled to the fluid tank 140, in other embodiments, the discharge system 130 may be coupled to the frame 110 in addition to or in place of the fluid tank 140. As another example and in another configuration, the gravity-fed emergency shower system 100 may also include an eye wash and/or a face wash system, which may also be coupled to the frame 110.

The frame 110 may be of unitary construction (e.g., a one-piece component) or be constructed from a series of components coupled together. The components may include, but are not limited to, pipes, rods, channel, etc. Further, the frame 110 may be constructed from any suitable material including, but not limited, metal, metal alloys, plastics, metal and plastic combinations, and the like.

While the frame 110 is shown to be of a substantially rectangular cross-sectional shape, it should be understood that a variety of shapes and sizes may be implemented with the frame 110. For example, in another embodiment, the frame 110 is of a square cross-sectional shape. In another example, the frame is of a circular cross-sectional shape. Thus, the relative size and shape of the frame 110 in FIG. 1 is exemplary and not meant to be limiting.

Further, in some embodiments and rather than the open configuration of the frame 110 shown in FIG. 1, the frame 110 may be coupled to a body or various shrouds/covers to form an enclosure, which includes at least one door. Thus, those seeking to use the gravity-fed shower system would then enter the enclosure where they would be substantially shielded from the outside environment. Accordingly, many configurations of the frame 110 and the gravity-fed emergency shower system 100 are possible with all such variations intended to fall within the scope of the present disclosure.

The control mechanism 120 is structured to actuate the discharge system 130 in order for a user to use the gravity-fed emergency shower system 100. The control mechanism 120 (e.g., actuation mechanism, controller, etc.) may be coupled to at least one of the frame 110 and the fluid tank 140. In this regard, at least one of the frame 110 and the fluid tank 140 supports the control mechanism 120. In the example depicted, the control mechanism 120 is coupled to the frame 110. As explained in more detail below, the control mechanism 120 is also coupled to the discharge system 130, such that the control mechanism 120 may be actuated to control, release, or otherwise enable discharge of fluid from the fluid tank 140 via the discharge system 130.

The control mechanism 120 is shown to include a handle 121 coupled to a tether 122. The tether 122 (e.g., rope, chain, etc.) is coupled to the frame 110 and operatively coupled to the discharge system 130. The handle 121 (e.g., user interface portion, hook, grab, etc.) is coupled to the tether 122 and is structured as a user interface portion that a user may grab, hold, and pull when he/she desires to use the gravity-fed emergency shower system 100. While the handle 121 is depicted as triangular-shaped, it should be understood that a variety of shapes (e.g., circular) and sizes may be used instead.

The discharge system 130 is coupled to the control mechanism 120, such that actuation of the control mechanism 120 actuates the discharge system 130 to provide fluid stored in the fluid tank 140. In the example depicted, the discharge system 130 includes a drain 151 (e.g., pipe, conduit, etc.) coupled to the fluid tank 140, a shower head 132 (e.g., fixture, shower fixture, spout, discharge head, etc.), and a main valve 131.

The main valve 131 is operable (e.g., selectively repositionable using the control mechanism 120) between an open and a closed position. In the open position, the main valve 131 permits fluid from the fluid tank 140 to flow through the drain 151 to the shower head 132 to the user. In the closed position, the main valve 131 prevents or substantially prevents fluid from the fluid tank 140 from flowing from the fluid tank 140 to the shower head 132. The main valve 131 may be structured as any conventional fluid flow control valve (e.g., ball valve, butterfly valve, etc.). It should be understood that the main valve 131 may be positioned in a variety of places (e.g., in the shower head 132), such that the depiction of the main valve 131 in the drain 151 is not meant to be limiting.

The shower head 132 is a shower head or fixture that may include one or more openings that actually discharge the fluid when the main valve 131 is in the open position. That said, the shower head 132 may have a variety of shapes, sizes, and configurations. For example, the shower head 132 may include a plurality of discharge openings, where each of the discharge openings has a funnel shape in order to accelerate the provided fluid (e.g., in a jet stream). Further, the one or more discharge openings may have a variety of shapes and sizes that may provide a variety of different fluid streams depending on the shape/size (e.g., cylindrical, frustoconical, etc.). All such variations are intended to fall within the scope of the disclosure.

The fluid tank 140 is structured as a reservoir, tank, or container for fluid that is selectively discharged via the discharge system 130 to a user of the gravity-fed emergency shower system 100. The fluid tank 140 may form an enclosure for the fluid or may be an open container (e.g., the top wall of the fluid tank 140 (the wall furthest from a bottom surface 141 of the fluid tank 140) may be omitted). Beneficially, the multiple stage discharge system 150 of the present disclosure is applicable with either configuration, such that expensive and complex pressurized tanks that are configured to provide fluid from the tank at a minimum pressure for a period of time may be eliminated. It should be understood that the size, shape, and structural configuration (e.g., insulated, not insulated, etc.) of the fluid tank 140 may be highly configurable (e.g., capable of holding 300 gallons of fluid, 500 gallons of fluid, etc.). For example, the fluid tank 140 may be rectangular shaped (like shown), cylindrical shaped, etc.

As mentioned above, the fluid tank 140 may serve as a reservoir or container for fluid, such as water. In operation, a user may fill the fluid tank 140 with water (e.g., via a hose, buckets, etc.). The fluid tank 140 may include a fill line indicator that provides an indication when the fluid tank 140 is at full capacity. Once at full capacity, the gravity-fed emergency shower system 100 may be used.

Figure 2:
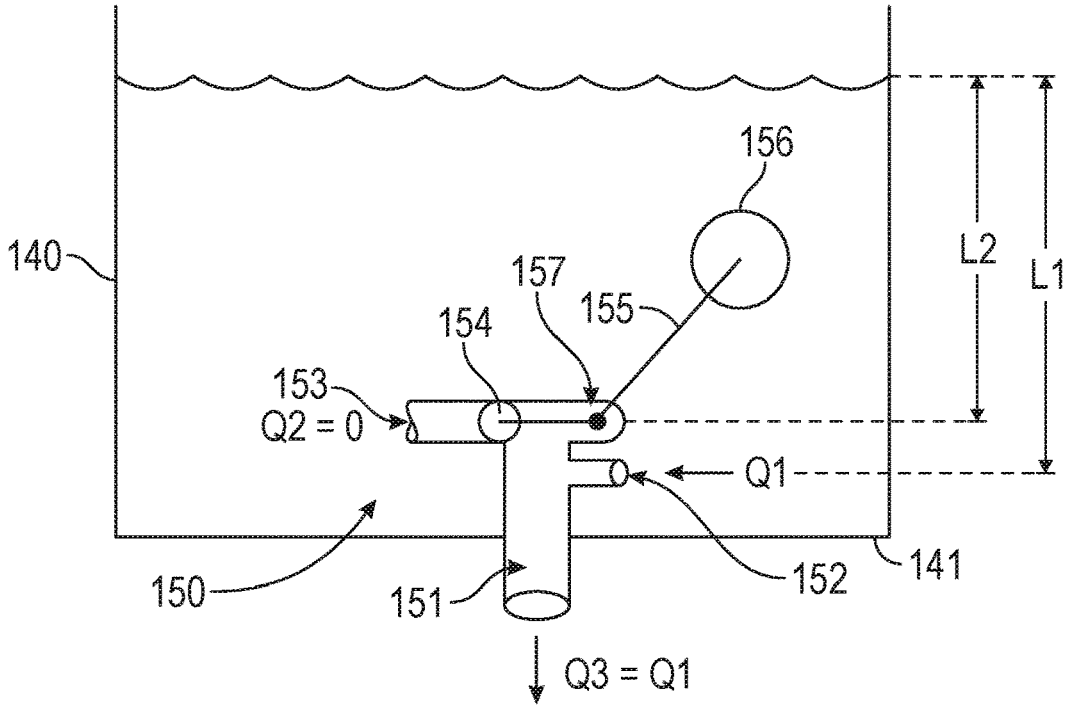
FIG. 2 is a front cross-sectional view of the fluid tank of FIG. 1 taken along line 2-2 where the fluid tank is filled with fluid to a first fluid tank fill level, according to an exemplary embodiment.
Figure 3:
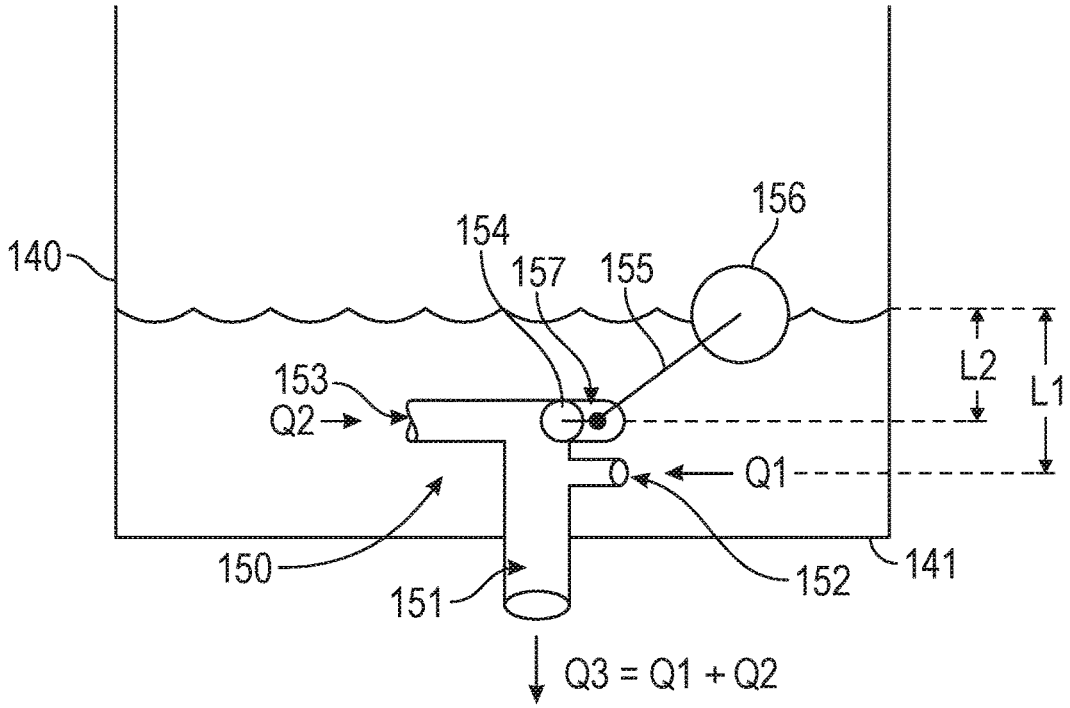
FIG. 3 is a front cross-sectional view of the fluid tank of FIG. 1 taken along line 2-2 where the fluid tank is filled with fluid to a second fluid tank fill level, according to an exemplary embodiment.

Before turning to the specifics of the multiple stage discharge system 150 as shown in FIGS. 2 and 3, a brief description of operation of the gravity-fed emergency shower system 100 may be described as follows. An unwanted substance is encountered by a user. The user walks or rushes (depending on the toxicity or urgency that he/she wishes to remove the substance) to the gravity-fed emergency shower system 100, grabs the handle 121, and pulls the handle 121 downward (e.g., towards the support surface and away from the fluid tank 140). Actuation of the handle 121 causes the main valve 131 to open, which allows fluid in the fluid tank 140 to flow from the fluid tank 140 via the drain 151 to the shower head 132 to the user. The provided fluid washes away or mostly washes away the unwanted substance from the user. Stoppage of the fluid from the shower head 132 may occur when the user releases the handle 121 to close the main valve 131 or when the fluid in the fluid tank 140 is substantially emptied, such that no more fluid is present that may be provided to the user.

With the above in mind, turning now to FIGS. 2 and 3, front cross-sectional views of the fluid tank 140 of FIG. 1 taken along line 2-2 where the fluid tank 140 is filled to a first fluid fill level (FIG. 2) and a second fluid fill level (FIG. 3) are depicted, according to exemplary embodiments. As shown, the first fluid tank fill level corresponds with a relatively fuller fill level than the second fluid tank fill level. In this regard, the first fluid tank fill level may be associated with a full or nearly full fill level while the second fluid tank fill level is associated with a nearly empty fluid level.

As shown, the multiple stage discharge system 150 includes the drain 151, a first opening 152 defined by the drain 151, a second opening 153 defined by the drain 151, and a valve mechanism cooperating with the second opening 153. Before turning to the specifics of the valve mechanism, the other components of the multiple stage discharge system 150 are firstly explained.

The drain 151 is fluidly coupled to the fluid tank 140, such that fluid in the fluid tank 140 may be received by the drain 151. The drain 151 is also fluidly coupled to the shower head 132 and includes the main valve 131. Thus, the drain 151 is an intermediary between the fluid tank 140 and the shower head 132. In this regard, the drain 151 is a conduit for fluid in the fluid tank 140 to reach the shower head 132. Coupling of the drain 151 to the fluid tank 140 may be via any type of coupling mechanism (e.g., adhesive, fasteners, etc.) and may include one or more sealing mechanisms that provide a fluid tight or relatively fluid tight seal between the fluid tank 140 and the drain 151. Similar coupling mechanisms may also be used to couple the drain 151 to the shower head 132. As shown, the drain 151 is cylindrically shaped (e.g., tubular) and at least partly disposed within the fluid tank 140. Of course, in other embodiments, the drain 151 may be a variety of other shapes and sizes (e.g., rectangular shaped, etc.).

The drain 151 defines a first opening 152 (e.g., first drain inlet, primary drain inlet, first tank outlet, primary tank outlet, first orifice, first aperture, etc.), which is a first orifice for fluid within the fluid tank 140 to flow through into the drain 151. In the example shown, the first opening 152 is defined by a tubular projection (e.g., a tube) extending outward and away from the drain 151 in a substantially perpendicular manner (e.g., laterally, horizontally). In other embodiments, the first opening 152 may be an opening defined by a side wall of the drain 151 (i.e., not defined by a tubular projection extending outward and away from the drain 151 structure (e.g., horizontally, vertically, etc.)).

The drain 151 also defines a second opening 153 (e.g., second drain inlet, secondary drain inlet, second tank outlet, secondary tank outlet, second orifice, second aperture, etc.), which is a second orifice for fluid within the fluid tank 140 to flow through into the drain 151. In the example shown, the second opening 153 is defined by a tubular projection (e.g., a tube) extending outward in a substantially perpendicular manner from the drain 151(e.g., laterally, horizontally). In other embodiments, the second opening 153 may be an opening defined by a side wall of the drain 151 (i.e., not a tubular projection extending outward and away from the drain 151 structure (e.g., horizontally, vertically, etc.)).

Thus, the drain 151 and the first and second openings 152, 153 are structured as a one-piece component. In other embodiments, the tubular projections that define openings 152, 153 may be coupled to the drain 151 (e.g., via one or more fasteners, joining processes such as welding, etc.). In this configuration, the drain 151 may be constructed from two or more components.

As described herein, the multiple stage discharge system 150 is structured to provide a fluid flow through the drain 151 at or above a minimum pressure for a relatively longer period of time than conventional gravity-fed shower systems (e.g., that do not include the multiple stages). In addition to the valve mechanism and overall structure of the multiple stage discharge system 150 that function to achieve this characteristic, several other features may be implemented with the multiple stage discharge system 150 that may also affect the fluid flow/pressure into the drain 151 to, in turn, control the fluid pressure from the fluid tank 140.

For any given fluid pressure at the drain 151, the flow rate of fluid out of the drain 151, through the main valve 131 and the shower head 132, and ultimately delivered to the user, depends upon a variety of factors, such as the viscosity of the fluid and the cross-sectional area at various points along the flow path of the fluid. Accordingly, for any given configuration of the gravity-fed emergency shower system 100 (e.g., a configuration where the main valve 131 is fully open, the shower head 132 has a known structural configuration, and the fluid is water), each pressure at the drain 151 has a corresponding flow rate of fluid. In this regard, the terms "minimum pressure" or "minimum flow rate" are used interchangeably to refer to a desired fluid pressure or flow rate in the drain 151 to the main valve 131. As the position of the main valve 131 (e.g., full open, partial open) and structural configuration of the shower head 132 (e.g., shape, size, and number of discharge openings) can affect the fluid pressure or flow rate provided to the user, the minimum pressure or minimum flow rate desired characteristics are judged, analyzed, observed, measured, or otherwise gauged proximate to, but upstream of the main valve 131.

With the above in mind, one way that the fluid flow or pressure may be controlled is to adjust the relative heights of the first opening 152 to the bottom surface 141 of the fluid tank 140, the second opening 153 to the bottom surface 141 of the fluid tank 140, and the height between the first and second openings 152 and 153 to control a fluid pressure at each of the first and second openings 152 and 153. Equation (1) shows an example method of calculating the pressure at each stage:

$$P=L*\rho*g \tag{1}$$

where P equals fluid pressure, L equals the height between the top of the fluid in the fluid tank to the point of interest (i.e., where the fluid pressure is desired to be determined, such as at the first opening 152), ρ equals the density of the fluid, and g is the acceleration due to gravity. Thus, placing the first opening 152 relatively closer to the bottom surface 141 will increase the "L" value (i.e., L1 in FIGS. 2 and 3) and, in turn, increases the maximum fluid pressure possible at the first opening 152. In comparison, placing the second opening 153 relatively closer to the top of the fluid tank 140 decreases the "L" value (i.e., L2 in FIGS. 2 and 3) to, in turn, decrease the maximum fluid pressure possible at the second opening 153. As will be appreciated by those of ordinary skill in the art, controlling the maximum pressure possible at the first and second openings may impact the fluid pressure in the drain 151 to affect the time duration that the system can sustain the minimum desired flow rate of fluid from the fluid tank 140.

As another example of a way that the fluid flow or pressure may be controlled is that the relative size, structure, and shape of each of the first and second openings 152 and 153 may be adjusted to affect a desired fluid pressure into the drain 151. In the example depicted, the first opening 152 has a relatively smaller cross-sectional size than the second opening 153. Applicant has determined that based on the maximum L1 value for the fluid tank (thus, L1 may change based on the fluid tank size), the cross-sectional size of the first opening 152 can be chosen/designed such that a flow rate (Q1) through the first opening 152 is at or above a minimum desired flow rate until fluid is permitted to flow through the second opening 153 such that a flow rate (Q3) out of the drain 151 is at or above the minimum desired flow rate. In this regard, the first opening 152 has a cross-sectional size that corresponds with or substantially with a restricted fluid flow rate to the drain 151 in order to i) maintain the minimum desired flow rate and ii) conserve fluid. In contrast and as shown, the second opening 153 has a relatively larger cross-sectional size than that of the first opening 152. Fluid flows through the second opening 153 at a flow rate (Q2). When the fluid pressure is low (e.g., due to a small L1 and L2 value), the larger cross-sectional size of the second opening 153 permits an increase in fluid flow to the drain 151 via the second opening 153 (in addition to the fluid flow (Q1) via the first opening 152) in order to maintain the flow rate (Q3) out of the drain 151 at or above the minimum desired flow rate. Thus, this structural configuration conserves fluid consumption yet, as described and shown below, maintains the flow rate (Q3) at or above a minimum desired flow rate for an extended period of time as compared to conventional gravity-fed shower systems.

However, this configuration is not meant to be limiting as other configurations may be used with at least one of the first and second openings 152, 153 in order to achieve or substantially achieve desired fluid flow characteristics via the openings 152, 153. For example, in contrast to the circular cross-sectional shape shown, a tapered cross-sectional shape may be implemented with at least one of the first and second openings 152 and 153. Further and while shown as being the same or substantially the same cross-sectional shape, the cross-sectional shapes of the first and second stages may differ in other embodiments (e.g., a square cross-sectional shape versus a circular cross-sectional shape). Thus, those of ordinary skill in the art will appreciate the high configurability of the size and shape of the first and second openings 152 and 153.

In this regard, a variety of fluid flow control devices may be implemented with the multiple stage discharge system 150 (in particular, the first and second openings 152 and 153) that may also affect the fluid pressure provided by the fluid tank 140.

Turning now to the valve mechanism, as shown, the valve mechanism includes a valve 154 coupled to a float 156 via a line 155. In this regard and in the example depicted, the valve mechanism is structured as a float valve. The float 156 is structured to move within the fluid tank 140 based on the fluid level in the fluid tank 140 to selectively open the valve 154 (to permit fluid to flow through the second opening 153 into the drain 151) and close the valve 154 (to prevent fluid to flow through the second opening 153 into the drain 151).

The valve 154 may be structured as any type of valve, component, or device that is able to both block/prevent and enable fluid from flowing into the drain 151 via the second opening 153. In this regard, the valve 154 is operable between an open position, where fluid is allowed to flow through the second opening 153 to the drain 151, and a closed position, where fluid is prevented or substantially prevented to flow throw the second opening 153 to the drain 151. In the example shown, the valve 154 is structured as a movable, slidable, or otherwise translatable object within the tube that defines the second opening 153 and the main portion of the drain 151 to selectively permit fluid flow via the second opening 153. In one configuration, the tube that defines second opening 153 has a tapered cross-sectional area, with the smallest cross-sectional size at or near the second opening 153 and the largest cross-sectional size at or near the connection point between the tube and the drain 151. In this regard, the object/valve is prevented from moving out of the tube that defines the second opening 153, yet can move towards the main section of the drain 151. In another example, the valve 154 is fixed within the tube that defines the second opening 153, yet is movable between the open and closed positions. For example, in this configuration, the valve 154 may be structured as a butterfly valve.

The float 156 may be any object that floats or substantially floats on the fluid (e.g., water) in the fluid tank 140. Further, the size and shape of the float 156 is highly configurable, with all such variations intended to fall within the scope of the present disclosure.

In the example shown, the line 155 represents a rigid rod. The rigid rod is able to exert a force onto the valve 154 to move, force, urge, or otherwise actuate the valve 154 between the open and the closed position. In another embodiment, the line 155 may be structured as a non-rigid line, such as a cable, a chain, or a rope. All such variations are intended to fall within the scope of the present disclosure.

As shown, the drain 151 includes a cavity 157. The cavity 157 is positioned away from the fluid flow path in the drain 151 and away from the second opening 153. In this regard, the cavity 157 serves as a receptacle for the movable valve 154 when the valve 154 is actuated to the full open position. In this regard, the "full open" position may be characterized by the valve 154 being fully received within the cavity 157, such that the valve 154 does not or only negligibly impacts the fluid flowing via the second opening 153 to the drain 151. In comparison, the "partial open" position refers to any position of the valve 154 that enables at least some fluid from the fluid tank 140 to flow into the drain 151 via the second opening 153.

It should be understood that different valve mechanisms may be implemented with the multiple stage discharge system 150. For example and as mentioned above, the valve 154 may be fixed or stationary proximate to the second opening (e.g., a butterfly valve). As another example, the line 155 may be a non-rigid line, such as a cable or a rope. Further, in other embodiments, more than the two stages may be included (e.g., a three stage system) where more than one of the stages includes a valve mechanism and the valve mechanisms may be the same or different from each other (e.g., two float valves implemented with two of the three stages). In this regard, any device that acts inversely with water depth to open an orifice/opening may be utilized.

Based on the foregoing and with reference to FIGS. 2 and 3, explanation of operation of the multiple stage discharge system 150 is described as follows. In FIGS. 2 and 3, Q3 represents the flow rate out of the drain 151. The multiple stage discharge system 150 maintains the flow rate Q3 at or slightly above a minimum desired flow rate throughout operation. In FIG. 2, the fluid in the fluid tank 140 is at a full or nearly full level. Before the user actuates the control mechanism 120 to open the main valve 131, the buoyancy acts on the float 156 to bias the valve 154 in the closed position. However, the first opening 152 is open and receiving fluid in the fluid tank 140. The closed position of the main valve 131 prevents the fluid from being discharged or emitted via the shower head 132. Next, the user actuates the control mechanism 120 (e.g., pulls on the handle) to open the main valve 131. Fluid is provided to the drain 151 via the first opening 152 at a flow rate of Q1. Because flow through the second opening 153 is prevented by the valve 154, FIG. 2 depicts Q3 as equaling Q1. Due to the relatively smaller size of the first opening 152, Q1 is only at or slightly above the minimum desired flow rate of Q3 until the valve 154 is opened. In this regard, even though the fluid pressure is high due to the fluid height (distance between the first opening 152 and the top of the fluid level in the fluid tank 140, L1), the relatively smaller sized first opening 152 restricts the fluid flow into the drain 151, thereby preventing an undesirably large flow rate Q3. As the fluid in the fluid tank 140 begins to decrease, the buoyancy force acting on the float 156 decreases. At some point, the buoyancy force subsides or falls below a threshold level, and the float 156 moves to actuate the valve 154. In this example, the valve 154 is a movable object and, as such, moves towards the cavity 157. During this movement, fluid is provided to the drain 151 via the second opening 153 at a flow rate of Q2. While fluid pressure at the first opening 152, and accordingly the flow rate Q1, decrease due to the decreasing fluid height, the additional fluid flow path via the second opening 153 functions to increase the flow rate Q3 to be approximately at or above the minimum desired flow rate. Thus, the flow rate in the drain 151 through each of the two stages—at this point—is the summation of Q1 and Q2. As a result, the flow rate Q3 out of the drain 151 is maintained at or above the minimum desired flow rate for a relatively longer time duration as compared to conventional gravity-fed shower systems.

Stoppage of use of the gravity-fed emergency shower system 100 may occur from either the fluid tank 140 emptying or the user releasing the handle 121 or otherwise performing an action that closes the main valve 131. The float 156 remains in the position when the main valve 131 is closed, such that the valve 154 may or may not be in the open position.

After the fluid tank 140 has been emptied or substantially emptied, a user may then refill the fluid tank 140. As the fluid is added to the fluid tank 140, the buoyancy of the fluid acts on the float 156 to move, urge, or otherwise force the valve 154 into the closed position (i.e., the object moves away from the cavity 157 towards the second opening 153 to block the second opening 153). Beneficially, this easy refill process avoids complicated processes that are implemented with pressurized fluid tanks, which require the tank to be sealed (i.e., not open to the environment) to pressurize the tank. In contrast, here, the fluid tank 140 can be open to the environment or not. Thus, the multiple stage discharge system 150 of the present disclosure is an easy-to-use, reliable, and economical solution for conserving water and extending the runtime of the gravity-fed shower system at a minimum desired pressure as compared to conventional gravity-fed systems.

Figure 4:
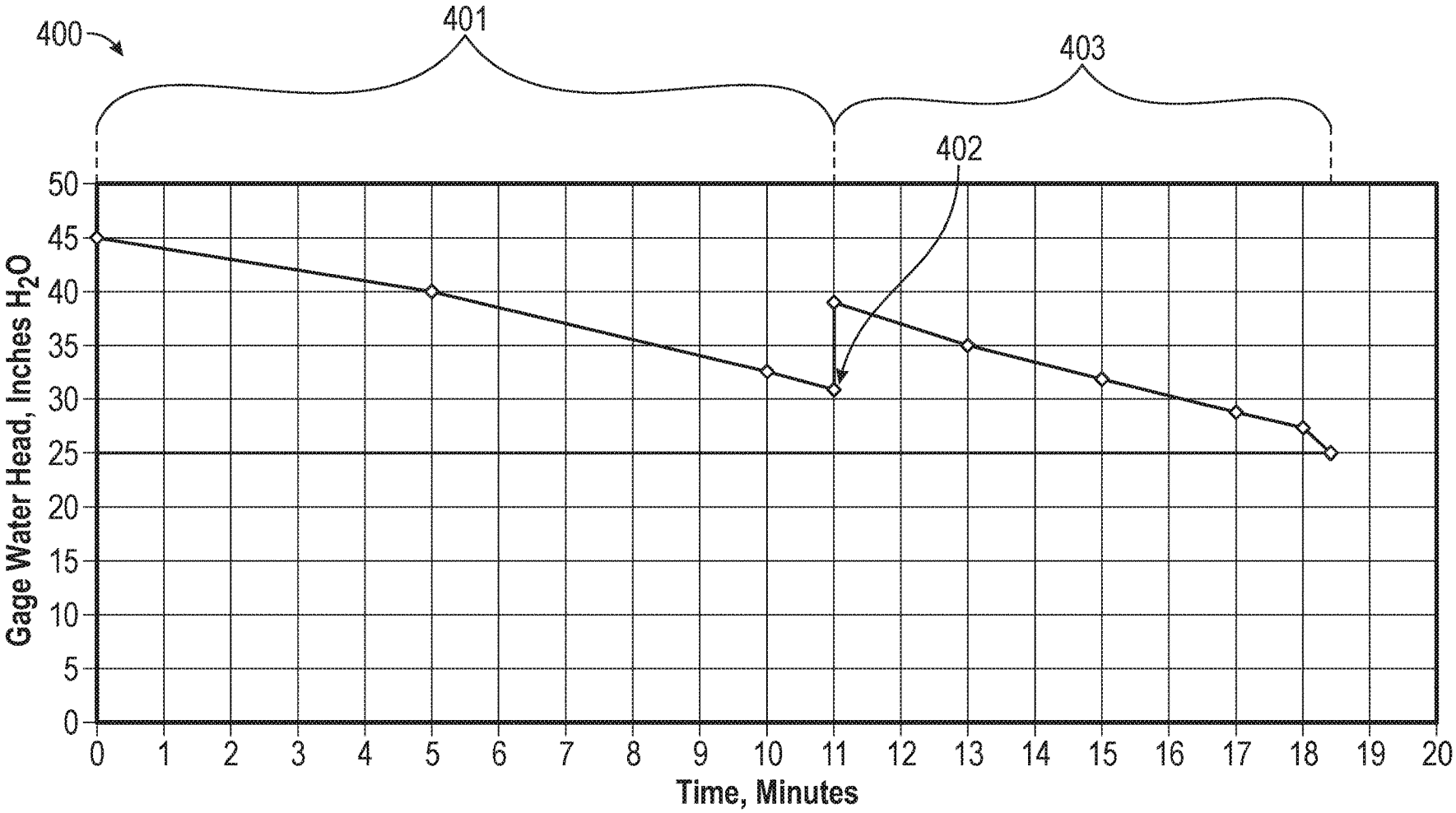
FIG. 4 is a graph depicting the discharge/flow characteristics of the gravity-fed emergency shower system of FIG. 1, according to an exemplary embodiment.
Figure 5:
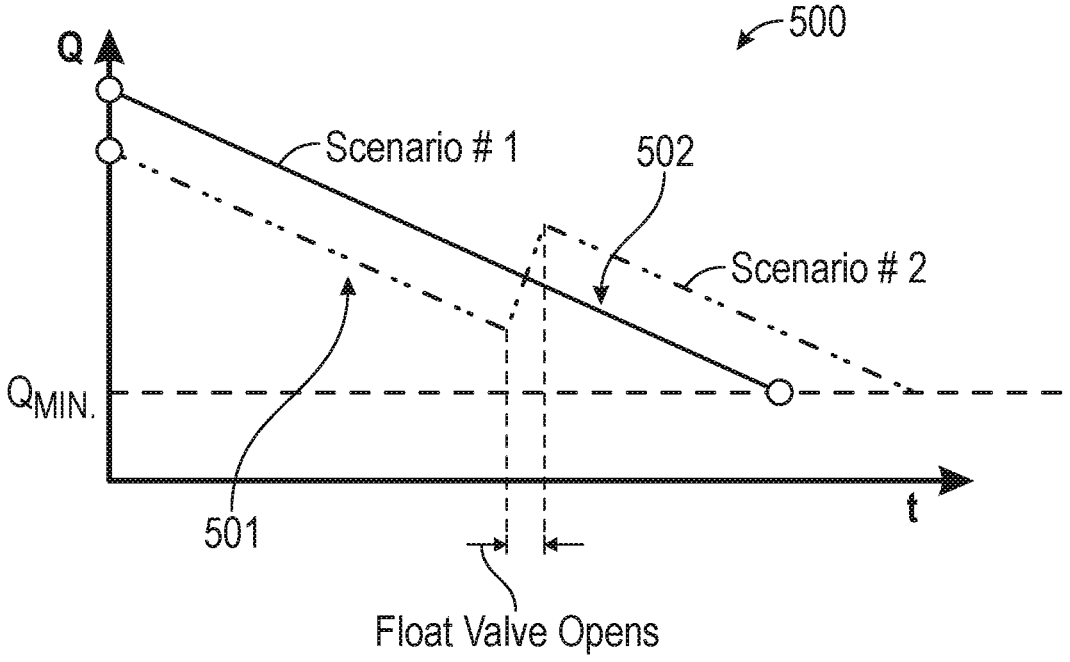
FIG. 5 is a graph depicting the discharge/flow characteristics of the gravity-fed emergency shower system of FIG. 1 compared alongside the simulated discharge characteristics of a conventional gravity-fed emergency shower system, according to an exemplary embodiment.

Turning now to FIGS. 4 and 5, graphs of the flow characteristics of a gravity-fed emergency shower system with the multiple stage discharge system are shown according to exemplary embodiments.

Referring first to FIG. 4, a graph 400 of time versus fluid pressure (e.g., at the outlet of the drain 151) for the multiple stage discharge system 150 is depicted. In graph 400, the minimum desired fluid pressure is 25 inches of water. Further, graph 400 depicts the pressure and associated flow characteristics after the main valve 131 has been actuated open. With this in mind, section 401 depicts the first stage, where fluid is provided only via the first opening 152. As the fluid in the fluid tank 140 decreases, the pressure at the first opening 152 decreases. As such and to maintain the minimum desired fluid pressure, at some point in time (here, at approx. 11 minutes after opening the main valve 131), the decreases in fluid pressure and buoyancy cause the valve mechanism (i.e., valve 154) of the multiple stage discharge system 150 to be actuated open to start the second stage (point 402). In this regard, section 403 represents the fluid pressure provided by fluid to the drain via each of the first and second openings 152 and 153. As can be seen, if the second stage were not included, the fluid pressure from the first stage would have likely fell below the minimum desired pressure threshold of 25 inches of water at some point before 15 minutes. With the second stage, the gravity-fed emergency shower system 100 is able to provide a fluid pressure of at or above the minimum desired pressure for slightly over 18 minutes. Applicant has performed the same simulation with a conventional gravity-fed emergency shower system and the runtime of shower with the minimum desired pressure was slightly less than 17 minutes (same size tank, same initial starting volume, and same discharge system configuration). Thus and beneficially, the multiple stage discharge system 150 of the present disclosure increased the runtime of the shower at the minimum pressure by approximately 1.5 minutes.

Turning now to FIG. 5, a graph 500 comparing the flow pattern of the multiple stage discharge system 150 in a gravity-fed emergency shower system (501) alongside a conventional flow pattern of a gravity-fed emergency shower system (502) is shown according to an exemplary embodiment. In graph 500, the minimum desired flow rate is shown as $Q_{min}$. As shown, the flow rate corresponding to the conventional gravity-fed emergency shower system (line 501) maintains the minimum desired fluid flow rate for a relatively shorter time duration than the multiple stage discharge system 150 implemented with the gravity-fed shower system (line 502) despite each system starting with the same fluid volume.

It is to be understood that the innovations disclosed herein are not limited to the details of construction and the arrangement of the components set forth in the description or illustrated in the drawings. The innovations are capable of other embodiments or being practiced or carried out in various ways. In this regard, it should be understood that the gravity-fed system (particularly the fluid tank 140 and multiple stage discharge system 150) shown and described herein may also be implemented with other gravity-fed fixture systems in addition to the shower system, such as eyewash systems, facewash systems, a combination thereof, and the like.

It is also to be understood that the phraseology and terminology employed herein is for the purpose of description and should not be regarded as limiting. In this regard, it should be understood that the terms used herein are intended to be broad terms and not terms of limitation.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is also important to note that the construction and arrangement of the elements of the multiple stage discharge system as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the disclosed embodiments. All such modifications are intended to be included within the scope of the present inventions as defined in the disclosed embodiments. The order or sequence of any process or method steps may be varied or re-sequenced according to alternative embodiments. In the disclosed embodiments, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present disclosure.

What is claimed is:

1. A gravity-fed shower system, the system comprising:
a fluid tank; and
a multiple stage discharge system coupled to the fluid tank and structured to at least partly control a fluid flow from the fluid tank, the multiple stage discharge system including:
a drain;
a first opening defined by the drain;
a second opening defined by the drain; and
a valve mechanism coupled to the second opening to selectively permit fluid in the fluid tank to flow through the drain via the second opening, wherein when a fluid level in the fluid tank decreases to at or below a threshold fluid level, at least a portion of the valve mechanism moves to permit fluid in the fluid tank to flow through the drain via the second opening.

2. The gravity-fed shower system of claim 1, wherein the valve mechanism includes a float coupled to a valve.

3. The gravity-fed shower system of claim 2, wherein the valve mechanism further includes a line coupling the float to the valve, and wherein the line is rigid.

4. The gravity-fed shower system of claim 2, wherein the valve is movable within a tube that defines the second opening, wherein the drain defines a cavity, and wherein when the fluid decreases to at or below the threshold fluid level, the valve moves at least partly into the cavity to open a fluid flow path through the second opening into the drain.

5. The gravity-fed shower system of claim 1, wherein the first opening is always fully open such that the fluid in the fluid tank is always received by the first opening when the fluid level in the fluid tank is at or above the first opening.

6. The gravity-fed shower system of claim 1, wherein the first opening has a relatively smaller cross-sectional size than the second opening.

7. The gravity-fed shower system of claim 1, wherein the first opening and the second opening are disposed within the fluid tank.

8. The gravity-fed shower system of claim 7, wherein the first opening is defined by a first tube extending outward and away from the drain, and wherein the second opening is defined by a second tube extending outward and away from the drain.

9. The gravity-fed shower system of claim 8, wherein the second opening is positioned at a greater distance from a bottom surface of the fluid tank than the first opening.

10. A multiple stage discharge system for a gravity-fed emergency shower system, the multiple stage discharge system comprising:
a drain;
a first opening defined by the drain;
a second opening defined by the drain; and
a valve mechanism coupled to the second opening to selectively permit fluid in a fluid tank of the gravity-fed emergency shower system to flow at least partly through the drain via the second opening, wherein when a fluid level in the fluid tank decreases to at or below a threshold fluid level, at least a portion of the valve mechanism moves to permit fluid in the fluid tank to flow through the drain via the second opening.

11. The multiple stage discharge system of claim 10, wherein the valve mechanism includes a float coupled to a valve.

12. The multiple stage discharge system of claim 11, wherein the valve mechanism further includes a line coupling the float to the valve, and wherein the line is rigid.

13. The multiple stage discharge system of claim 11, wherein the valve is movable within a tube that defines the second opening, wherein the drain defines a cavity, and wherein when the fluid decreases to at or below the threshold fluid level, the valve moves at least partly into the cavity to open a fluid flow path through the second opening into the drain.

14. The multiple stage discharge system of claim 10, wherein the first opening and the second opening are disposed within the fluid tank.

15. The multiple stage discharge system of claim 14, wherein the first opening is defined by a first tube extending outward and away from the drain, and wherein the second opening is defined by a second tube extending outward and away from the drain.

16. The multiple stage discharge system of claim 15, wherein the second opening is positioned at a greater distance from a bottom surface of the fluid tank than the first opening.

17. The multiple stage discharge system of claim 10, wherein the first opening has a relatively smaller cross-sectional size than the second opening.

18. The multiple stage discharge system of claim 10, wherein the drain with the first opening and the second opening is a one-piece component.

19. A method of controlling a discharge pressure of a fluid in a fluid tank of a gravity-fed emergency shower system, comprising:

providing a fluid tank structured to hold a volume of fluid;

disposing a drain at least partly within the fluid tank, wherein the drain is coupled to the fluid tank;

providing a first opening in the drain;

providing a second opening in the drain;

disposing a valve in the drain, wherein the valve is movable between an open position and a closed position, wherein in the open position, the valve permits the fluid in the fluid tank to flow through the second opening into the drain and wherein in the closed position, the valve prevents the fluid in the fluid tank to flow through the second opening into the drain; and moving the valve to the open position when the fluid in the fluid tank decreases to permit fluid in the fluid tank to flow through the drain via the second opening.

20. The method of claim 19, wherein the first opening has a relatively smaller cross-sectional size than the second opening.

* * * * *